US011918081B1

(12) United States Patent
Balderrama-Corona

(10) Patent No.: US 11,918,081 B1
(45) Date of Patent: Mar. 5, 2024

(54) ARTICLE OF FOOTWEAR WITH BUILT-IN DRYING SYSTEM

(71) Applicant: Jesus Balderrama-Corona, Brawley, CA (US)

(72) Inventor: Jesus Balderrama-Corona, Brawley, CA (US)

( * ) Notice: Subject to any disclaimer, the term of this patent is extended or adjusted under 35 U.S.C. 154(b) by 63 days.

(21) Appl. No.: 17/940,162

(22) Filed: Sep. 8, 2022

(51) Int. Cl.

| | |
|---|---|
| ***A43B 7/06*** | (2006.01) |
| ***A43B 3/12*** | (2006.01) |
| ***A43B 3/38*** | (2022.01) |
| ***A43B 3/40*** | (2022.01) |
| ***A43B 3/44*** | (2022.01) |
| ***A43B 7/00*** | (2006.01) |
| ***A43B 7/08*** | (2022.01) |

(52) U.S. Cl.
CPC ..... *A43B 7/081* (2013.01); *A43B 3/12* (2013.01); *A43B 3/122* (2013.01); *A43B 3/128* (2013.01); *A43B 3/38* (2022.01); *A43B 3/40* (2022.01); *A43B 3/44* (2022.01); *A43B 7/005* (2013.01); *A43B 7/06* (2013.01)

(58) Field of Classification Search
CPC ..... A43B 7/06; A43B 7/081; A43B 7/0005; A43B 3/38; A43B 13/12
USPC ..... 36/11.5, 3 R
See application file for complete search history.

(56) References Cited

U.S. PATENT DOCUMENTS

| | | | | |
|---|---|---|---|---|
| 9,107,468 | B1 * | 8/2015 | Xiong | A43B 7/005 |
| 10,736,377 | B1 * | 8/2020 | Fotouhie | A43B 7/081 |
| 2005/0060906 | A1 * | 3/2005 | Zimerfeld | A43B 3/34 36/3 R |
| 2005/0235523 | A1 * | 10/2005 | Flechsig | A43B 13/182 36/3 R |
| 2009/0113762 | A1 * | 5/2009 | Leimer | A43B 7/081 36/3 R |
| 2010/0005687 | A1 * | 1/2010 | Ramadoro (AN) | A43B 3/0042 36/29 |
| 2012/0018418 | A1 * | 1/2012 | Shantha | A43B 7/02 219/482 |
| 2019/0159546 | A1 * | 5/2019 | Cohen | A43B 7/02 |
| 2021/0112919 | A1 * | 4/2021 | Marston | A43B 3/108 |

* cited by examiner

*Primary Examiner* — Marie D Bays
(74) *Attorney, Agent, or Firm* — Bay State IP, LLC

(57) ABSTRACT

This disclosure represents a novel article of footwear that has a built-in toe drying system. The footwear is preferably in the form of a sandal having a sole and a strap attached to opposite sides of the sole and fastened to the top of the sole near forefoot region. More specifically, the footwear has a pair of micro fans releasably mounted in openings disposed in the strap. One micro fan is connected to a duct integrated in strap and the other micro fan is connected to a duct positioned along the side of the sole. The airflow generated by the micro fans are directed towards respective connected ducts such that the airflow is expelled through holes to dry moisture and water on foot of a wearer of the footwear. The sole has a plurality of ripples on top surface thereof and the ripples facilitate drainage of water.

7 Claims, 7 Drawing Sheets

ARTICLE OF FOOTWEAR WITH BUILT-IN DRYING SYSTEM

FIELD OF THE INVENTION

The present invention relates generally to the footwears. More specifically, the present invention relates a novel footwear with a built-in toe drying system. The sandal is designed to dry the toes and spaces in between using the airflow generated by the built-in fans which is directed through internal ducts in the strap and sole of the sandal. Accordingly, this disclosure makes specific reference thereto the present invention.

BACKGROUND OF THE INVENTION

By way of background, many people like to take bath wearing their footwear. Such people face a common problem of accumulation of water and moisture under and around toes which is not only discomforting but is also injurious to health. Similarly, people visiting beach, pools and the like face the problem of wet feet. Conventional footwears are configured to get wet easily and do not provide any means of drying the feet accommodating the footwears. Generally, for drying feet and especially area under and around toes and fingers, people use a clothing material such as a towel, however, a person is required to bend to dry the fingers and toes which is difficult for people with limited dexterity and people having injuries. By having feet wet for a long time, people may face the problem of trench foot which may cause blisters, blotchy skin, redness and more.

Existing methods of cleaning and drying toes and fingers are not only inefficient but are difficult to implement. Further, moisture in the toes that can lead to skin irritations or fungus such as athlete's foot (tinea pedis). As a result, people desire a more efficient way of drying wet feet quickly without any manual effort that dries their feet automatically. Further, people desire improved footwear that helps in automatic drying of moisture and water trapped between toes and fingers of feet of a wearer.

The footwear of the present invention overcomes the problems stated in the prior art and helps in automatic drying of moisture and water on foot of a user by automatic expelling air on foot of a wearer.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, is a footwear designed to dry the toes and spaces therebetween using the airflow generated by the built-in micro fans. The micro fans are positioned in the strap of the footwear and are used for generating airflow. One micro fan generates airflow and directs towards a duct integrated in the strap of the footwear and the other micro fan generates an independent airflow and directs towards another duct integrated along contour of the sole of the footwear. The duct in the strap has a plurality of holes for expelling air onto forefoot region of the sole and the forefoot region has a plurality of holes for expelling air flowing through the duct of the sole. The micro fans have integrated battery for providing electrical power and have a sensor each for automatically activating the fan of the micro fans.

In yet another embodiment, a toe drying system configured to be integrated in a footwear is disclosed. The drying system includes two micro fans installed on opposite sides of the strap, one micro fan is connected to a duct integrated on the sole, another micro fan is connected to a second duct integrated on the strap, the micro fans are configured to independently generate airflow for drying moisture and water on foot of a wearer of the footwear. A plurality of holes disposed on the sole expel air from the duct integrated on the sole and a second plurality of holes disposed on the strap duct expels air flowing in the strap duct onto instep of the wearer.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
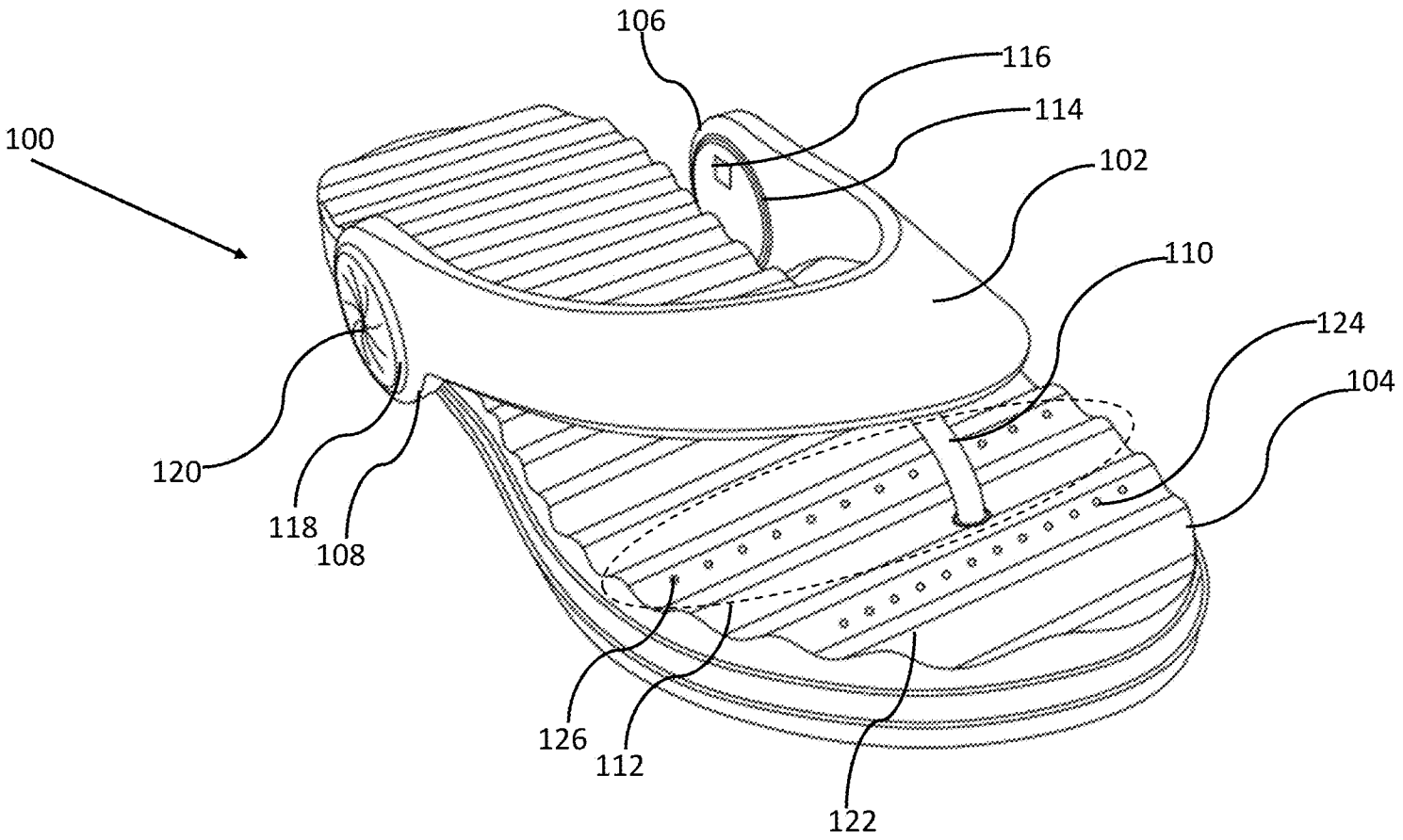
FIG. 1 illustrates a perspective view of one potential embodiment of the footwear with built-in toe drying system of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown.

Thus, in other embodiments, any of the features described herein from different embodiments may be combined.

For purposes of the present detailed description, unless specifically disclaimed: the singular includes the plural and vice versa; the words "and" and "or" shall be both conjunctive and disjunctive. Directional adjectives and adverbs, such as fore, aft, medial, lateral, proximal, distal, vertical, horizontal, front, back, left, right, etc., may be with respect to an article of footwear when worn on a user's foot and operatively oriented with a ground-engaging portion of the sole structure seated on a flat surface, for example.

Referring initially to the figures, FIG. 1 illustrates a perspective view of one potential embodiment of the footwear with built-in toe drying system of the present invention in accordance with the disclosed architecture. The footwear 100 of the present invention is preferably in the form of a sandal or any footwear that is generally worn during shower or on beach or pool. Preferably, the footwear 100 has straps to cover top of the foot and for securing the footwear 100 on the foot. The footwear 100 often comes in the form of pairs where a separate footwear 100 is available for each foot of a human. More specifically, the footwear 100 has a strap 102 affixed to the insole 104 for supporting foot of a user. The strap 102 is substantially V-shaped and extends from a first end 106 to a second end 108 wherein the first end 106 and the second end 108 are positioned linearly on opposite sides of the insole 104.

Figure 3:
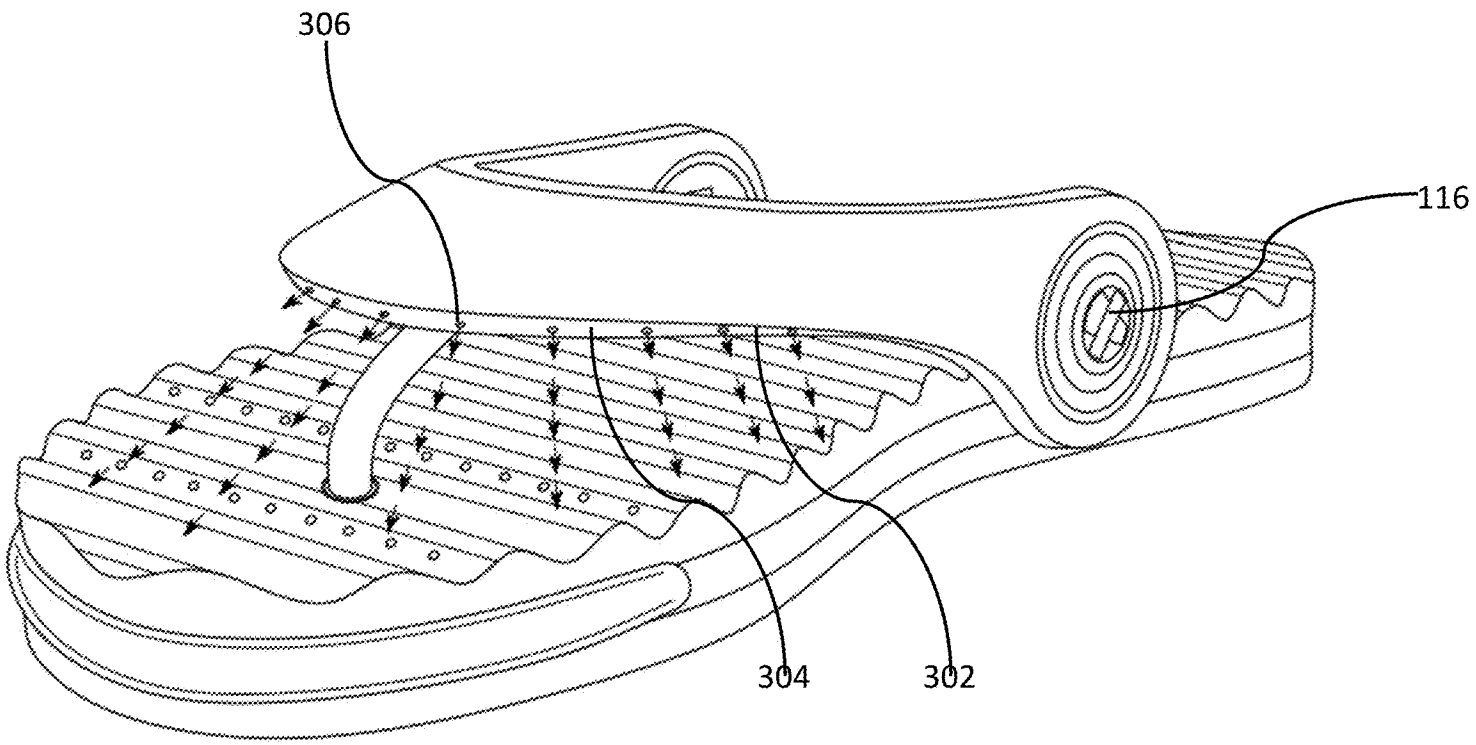
FIG. 3 illustrates another perspective view of the footwear 100 of the present invention showing the duct along the strap for airflow over foot in accordance with the disclosed architecture.

The strap 102 is designed such that the opposite ends 106,108 have larger width than width of the remaining length of the strap 102. The strap 102 is fastened to a flexible joint 110 which is affixed to the insole 104 at the forefoot region 112. The first end 106 has an opening 114 for accommodating a first micro fan 116 that is configured to generate an airflow directed to a duct (as shown in FIG. 3) inside the strap 102 and the flexible joint 110. The micro fan 116 is releasably mounted in the hole/opening 114 and is used for providing airflow over the foot of a wearer.

Figure 2:
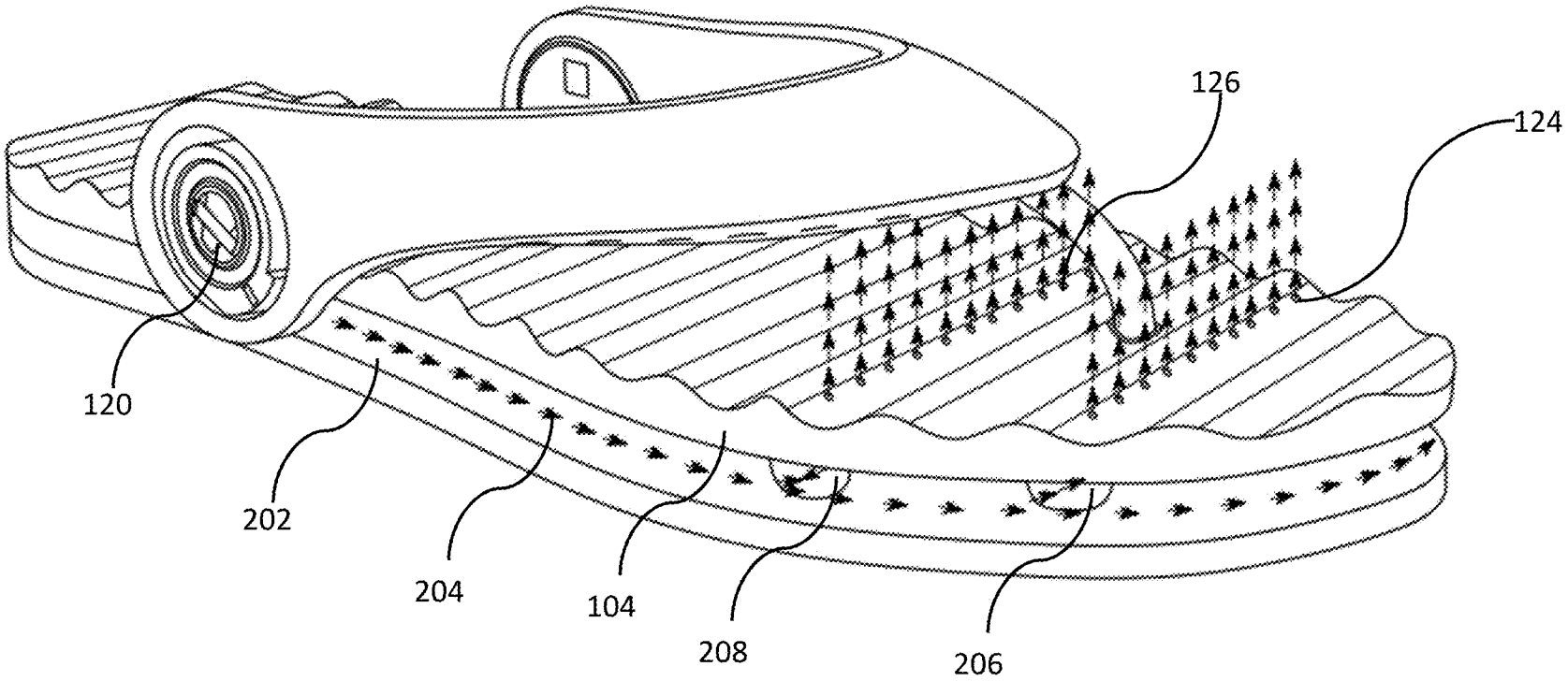
FIG. 2 illustrates a side perspective view of the sandal 100 of the present invention showing the duct along contour of the sole for airflow under foot in accordance with the disclosed architecture.

The second end 108 has an opening 118 for accommodating a second micro fan 120. The micro fans 116,120 are similar in construction and specification and are automatically activated when the moisture is detected in the footwear as described in detail in FIG. 5. The micro fan 120 is designed to generate an independent airflow and is directed to the duct disposed along the insole as shown in FIG. 2. The flow of air generated by the micro fans 116,120 connected to the ducts integrated on the sole 104 and the strap 102 facilitates homogeneous diffusion of air under and over the foot of a wearer of the footwear 100.

The sole 104 has a plurality of transversal ripples 122 along the surface thereof for easy and efficient water drainage. The forefoot region 112 has a plurality of minute openings 124,126 that are configured to expel air transmitted through the duct along the sole 104. The expelled air is generated by the second micro fan 120 and is independent of operation of the first micro fan 116.

Recognizably, the shape, size, material composition, and method of manufacture of the footwear 100 may be varied, singly or collectively, to accommodate practically any conventional or nonconventional footwear application. It should be noted the individual components including strap 102, sole 104 and flexible joint 110 of the sandal 100, once cut to shape and size, may be stitched, adhesively bonded, fastened, welded or otherwise joined together to form an interior void for comfortably receiving a foot.

FIG. 2 illustrates a side perspective view of the sandal 100 of the present invention showing the duct along contour of the sole for airflow under foot in accordance with the disclosed architecture. As illustrated, an internal sole duct 202 is disposed along the contour of the sole 104 such that the airflow 204 generated by the micro fan 120 is transmitted along the duct 202. The duct 202 functions as a channel through which the airflow 204 travels from the micro fan 120 to dry the foot from the bottom.

A pair of channels 206,208 are positioned transversely along the forefoot region 112 such that the first set of minute openings 124 positioned along the channel 206 and a second set of minute opening 126 positioned along the channel 208 receive airflow 204 from the duct 202 through the channels 206,208 respectively. The channels 206,208 are coupled with the duct 202 and receive a portion of the airflow which is expelled via the openings 124,126. It should be appreciated that the micro fan 120 is designed such that the generated airflow 204 is directed under the foot of a wearer along the duct 202. The duct 202 is waterproof, durable, soft and does not obstruct the conventional functionality of the footwear 100 while providing under the foot airflow for absorbing and drying moisture and water.

FIG. 3 illustrates another perspective view of the footwear 100 of the present invention showing the duct along the strap for airflow over foot in accordance with the disclosed architecture. The micro fan 116 is used for generating airflow 304 directed to a duct 302, the duct 302 is positioned along the strap 102 such that a plurality of holes 306 positioned along the duct 302 expels the airflow towards instep of a foot of the wearer of the footwear 100. More specifically, the holes 306 are designed such that air is expelled towards the top surface of the sole 104 such that instep and toes of the wearer dry easily without any manual intervention. The duct 302 is securely disposed along contour of the strap 102 such that a uniform airflow is expelled by the holes 306.

Figure 4:
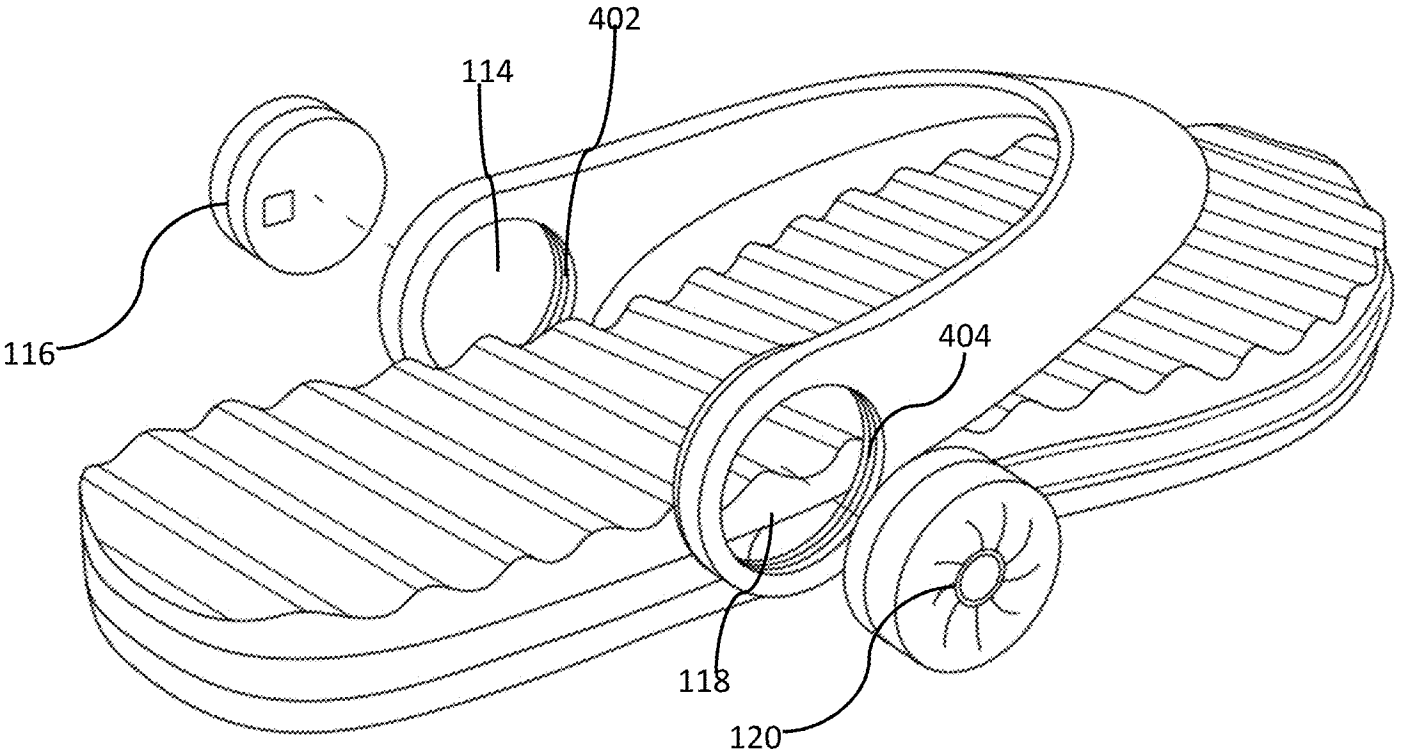
FIG. 4 illustrates a perspective view showing the micro fans being released from the strap of the footwear 100 in accordance with the disclosed architecture.

FIG. 4 illustrates a perspective view showing the micro fans being released from the strap of the footwear 100 in accordance with the disclosed architecture. The micro fans 116,120 are releasably mounted in the respective openings 114,118 such that the airflow from the micro fan 116 is directed along the strap 102 and the airflow from the micro fam 120 is directed along sole of the footwear 100. The micro fans 116,120 are designed to be rotatable inside the openings 114,118 such that the grooves 402,404 in the openings or holes 114,118 securely accommodates the micro fans 116,120 while allowing a user to rotate the micro fans 116,120 for releasing or engaging in the grooves 402,404.

For releasing each micro fan, the fan must be rotated at least 180 degrees from the engaged position such that the micro fan becomes loose and is released easily without any physical damage. This allows a user to release the micro fans 116,120 for a variety of reasons such as recharging the micro fans, storing the micro fans and more.

Figure 5:
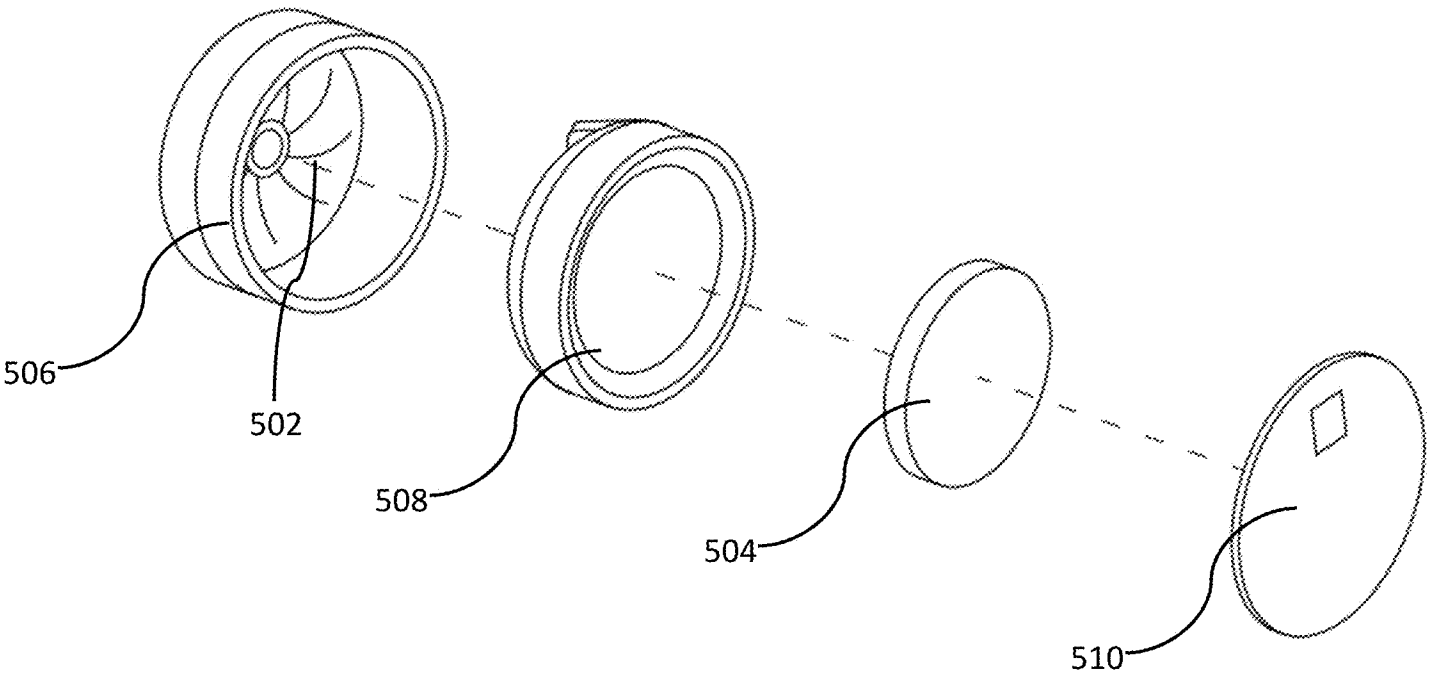
FIG. 5 illustrates an exploded view of an exemplary micro fan used in the drying system integrated footwear of the present invention in accordance with the disclosed architecture.

FIG. 5 illustrates an exploded view of an exemplary micro fan used in the drying system integrated footwear of the present invention in accordance with the disclosed architecture. The micro fan used in the present invention is especially designed to be used with the sandal 100 and in the present embodiment, structure of the micro fan 116 is described. But it should be noted that the structure of the other micro fan 120 is same and may have same specifications. As illustrated, a fan 502 is positioned for generating a desired airflow which receives electric power from a built-in button battery 504. Housing 506 of the fan 502 is configured to accommodate the battery 504 and USB C charging port 508. The USB C charging port 508 is used for receiving a charging cord for recharging the battery 504. In the preferred embodiment, the fan 502 has magnetic connections for recharging but in alternative embodiments, may incorporate wireless charging.

An activation sensor 510 is used for automatically activating the fan 502 to generate the airflow. The activation sensor 510 may employ a proximity sensor and a moisture detection sensor such that the fan 502 is activated when the footwear 100 is worn by a user and moisture is present in the footwear. The micro fans are structured in a leakproof manner and is waterproof. Further, the micro fans are durably constructed to avoid any physical damage while the footwear 100 is used by a user.

Figure 6:
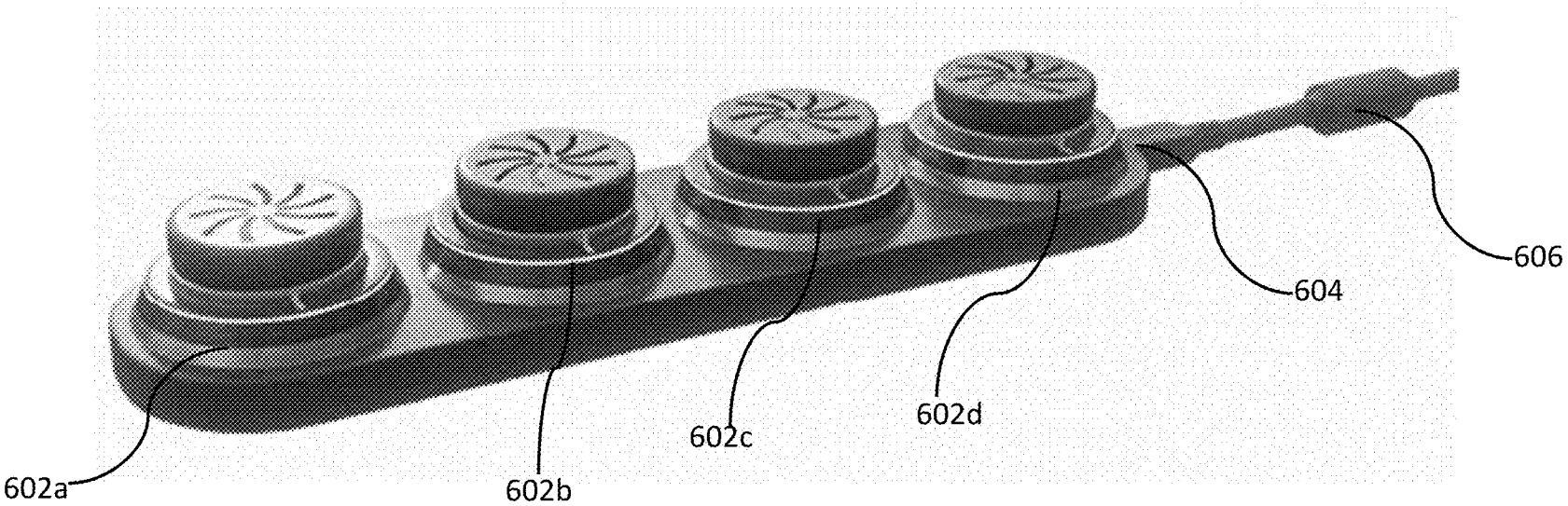
FIG. 6 illustrates a perspective view of a micro fans charger that comes along with the pair of footwears of the present invention in accordance with the disclosed architecture.

FIG. 6 illustrates a perspective view of a micro fans charger that comes along with the pair of footwears of the present invention in accordance with the disclosed architecture. The charger 600 is a portable charger that is easy for storage and transportation while travelling. The charger 600 has a plurality of micro fan charging ports 602*a-d* for accommodating and charging micro fans. The ports 602*a-d* may function simultaneously thereby allowing charging of a plurality of micro fans at the same time. Further, a USB C port 604 is positioned in the charger 600 for receiving a USB C cord 606 for providing electrical power to the charger 600.

It should be appreciated that the charger 600 can have any shape, size and number of charging ports as per preference of users. Also, the charger 600 and a pair of footwears can be available together in the form of a kit.

Figure 7:
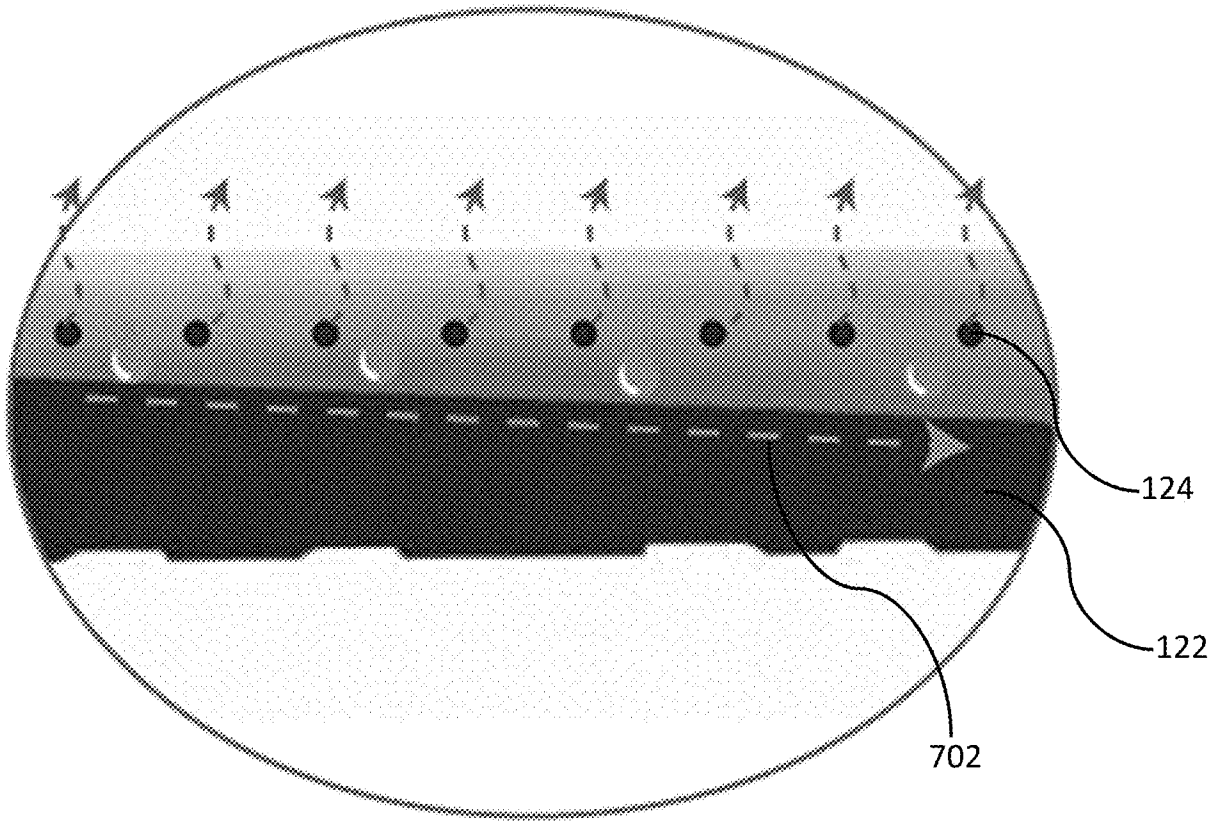
FIG. 7 illustrates a cross sectional view of sole of the footwear illustrating flow of water towards outside of the sole to help draining water in accordance with the disclosed architecture.

FIG. 7 illustrates a cross sectional view of sole of the footwear illustrating flow of water towards outside of the sole to help draining water in accordance with the disclosed architecture. As illustrated, each ripple 122 has a valley 702 having an inclination that favors the flow of water towards the outside of the surface of the sole 104, thus helps in draining water from the sole 104 and quickly drying the footwear 100.

The airflow from the duct 202 around the sole (as described in FIG. 2) leaves the duct 202 and expels through the minute holes 124,126 to dry the moisture in toes and space between them. It should be noted that the ripple of the sandal is uniquely designed to facilitate drainage of water from the feet of a wearer while also providing a secure and comfortable grip to a user.

The sole of the footwear 100 may be fabricated from any one or combination of a variety of materials, such as textiles, engineered foams, polymers, natural and synthetic leathers, etc.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "footwear", "footwear with built-in toe drying system", and "sandal" are interchangeable and refer to the footwear with built-in toe drying system 100 of the present invention.

What is claimed is:

1. An article of footwear comprising:

a sole configured to support thereon the foot of a user;

a strap attached to the sole structure and configured to support foot of the user;

a pair of micro fans, each micro fan of the pair of micro fans is releasably mounted in a hole of the strap;

a first micro fan of the pair of the micro fans is coupled to a duct disposed along the side surface of the sole;

a second micro fan of the pair of the micro fans is coupled to a duct disposed in the strap;

a plurality of minute openings disposed in forefoot region of the sole;

an airflow generated by the first micro fan travels along the duct disposed along the side surface of the sole and expelled from the plurality of minute openings; and an independent airflow generated by the second micro fan travels along the duct disposed in the strap to expel on top surface of foot of the user.

2. The footwear of claim 1, further comprising a plurality of ripples on top surface of the sole, wherein each ripple has a valley with inclination configured to facilitate drainage of water from foot of the wearer.

3. The first micro fan of claim 1, further comprising a battery and an activation sensor wherein the battery provides electric power to the fan.

4. The second micro fan of claim 1, further comprising a battery and an activation sensor wherein the battery provides electric power to the fan.

5. A footwear with a built-in toe drying system comprising:

a pair of micro fans;

a first duct integrated in a strap of the footwear;

a second duct integrated in sole of the footwear;

a first micro fan of the pair of the micro fans configured to generate an airflow directed to the first duct;

a second micro fan of the pair of the micro fans configured to generate another airflow directed to the second duct;

a plurality of minute openings coupled to the second duct; the plurality of minute openings configured to expel air flowing through the second duct to dry moisture from the toes of foot of a wearer of the footwear; and a plurality of holes disposed along the first duct for expelling airflow on the sole of the footwear.

6. The footwear of claim 5, further comprising a plurality of ripples, wherein each ripple has a valley with inclination configured to facilitate drainage of water from foot of the wearer.

7. The footwear of claim 5 has an accompanied charger configured for charging a plurality of micro fans.

* * * * *